US006735947B1

(12) United States Patent
Dormeier et al.

(10) Patent No.: US 6,735,947 B1
(45) Date of Patent: May 18, 2004

(54) STEAM POWER PLANT

(75) Inventors: Dieter Dormeier, Mannheim-Kaefertal (DE); Wahid Raafat Morcos, Heidelberg (DE); Henry Koenig, Lambsheim (DE); Henry Laier, Reilingen (DE); Helmut Ruediger, Heidelberg (DE); Bernd Abroell, Heidelberg (DE)

(73) Assignee: Alstom Power Generation AG, Mannheim (DE)

( * ) Notice: Subject to any disclaimer, the term of this patent is extended or adjusted under 35 U.S.C. 154(b) by 0 days.

(21) Appl. No.: 09/856,731

(22) PCT Filed: Nov. 22, 1999

(86) PCT No.: PCT/CH99/00557

§ 371 (c)(1),
(2), (4) Date: Jul. 12, 2001

(87) PCT Pub. No.: WO00/31380

PCT Pub. Date: Jun. 2, 2000

(30) Foreign Application Priority Data

Nov. 25, 1998 (EP) ..... 98911166

(51) Int. Cl.[7] ..... F01K 13/00
(52) U.S. Cl. ..... 60/645; 60/670
(58) Field of Search ..... 60/645, 670

(56) References Cited

U.S. PATENT DOCUMENTS 3,799,253 A * 3/1974 Kelp ..... 165/111
4,199,857 A * 4/1980 Meuschke et al. ..... 29/426.3
5,675,881 A * 10/1997 Stadelmann ..... 29/402.08
6,230,493 B1 * 5/2001 Hauser et al. ..... 60/645

FOREIGN PATENT DOCUMENTS

| | | |
|---|---|---|
| BE | 669251 | * 12/1965 |
| DE | 1426918 | * 5/1969 |
| DE | 8006136 | * 3/1980 |

* cited by examiner

*Primary Examiner*—Hoang Nguyen
(74) *Attorney, Agent, or Firm*—Burns, Doane, Swecker & Mathis, L.L.P.

(57) ABSTRACT

The invention relates to a steam power plant which consists essentially of a steam generator (1), a turbo group comprising a condensing steam turbine (2) and generator (3), a water-cooled condenser (4) and a bled-steam-heated preheating system. In said steam power plant all components, including the fuel storage area (6), are situated at ground level and in the open air. The turbo group (2, 3) and the condenser (4), the preheating system with associated pumps and the transformers (7) are arranged such that a gantry crane is able to pass over them. The steam generator (1), flue gas cleaning system (16) and the chimney (17) are positioned in a row along a common flue gas axis (18) and the turbo group (2, 3) arranged in the immediate vicinity and parallel thereto. As seen from the main wind direction (9), the coal storage area (6) is positioned downwind from the turbo group (2, 3) and the steam generator (1).

13 Claims, 6 Drawing Sheets

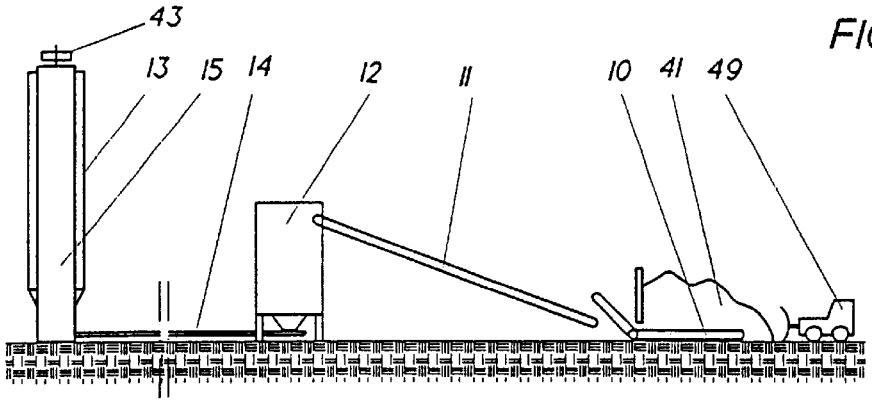
FIG. 4
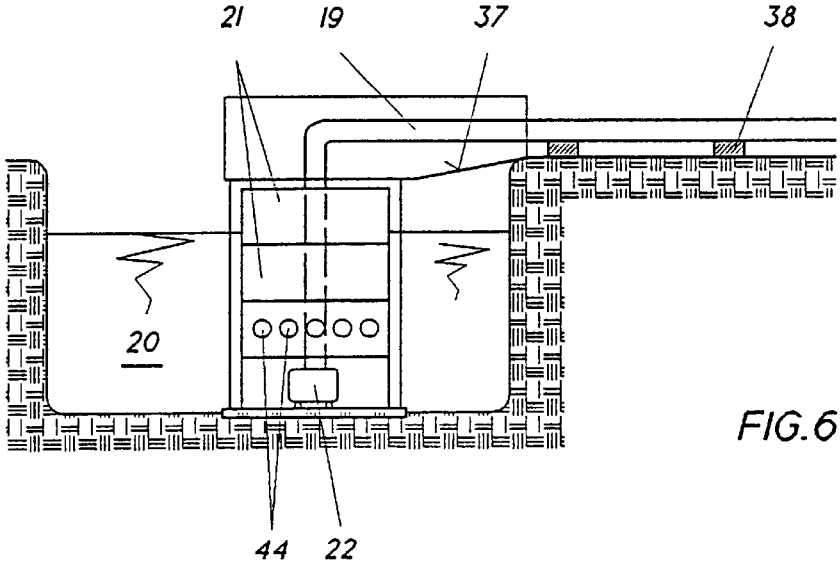
FIG. 6
FIG. 7
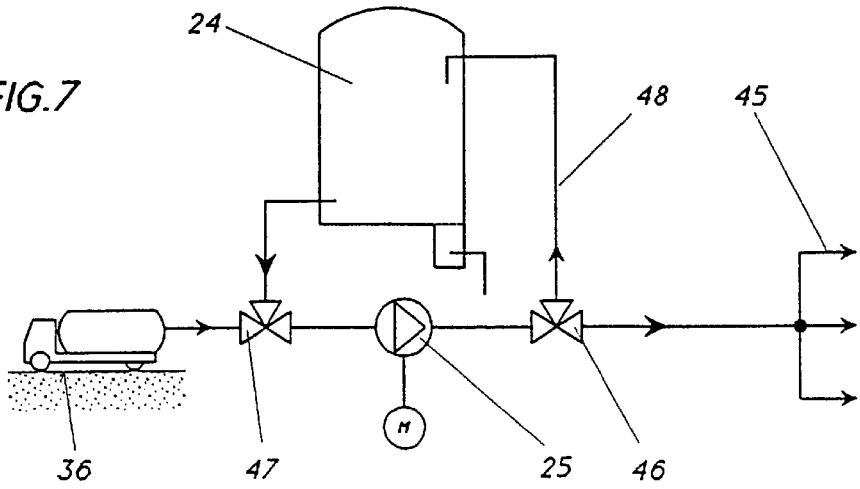

STEAM POWER PLANT

FIELD OF TECHNOLOGY

The invention relates to a steam power plant, comprising essentially a steam generator, a turbo group with condensation steam turbine and generator, a water-cooled condenser, and a bleeder steam-heated pre-heater system.

STATE OF THE ART

Such power plants are usually produced according to customer specification and site requirements and therefore involve lengthy project development, planning, and construction times and, as a result, high costs. Especially the construction time in these customer specification-oriented power plants is influenced by the fact that a very detailed advance engineering is not possible, and essential aspects of the work, for example the construction portion, which should be processed as early as possible, only can be started with a delay.

It is known per se to reduce the construction time by building power plants using open air construction. But this type of construction again causes a number of disadvantages with respect to their operation as well as maintenance and repair. In this connection, DE 1426918 A1 discloses the concept of a steam power plant designed to be built in a shorter construction time and reduced investment costs, and which is supposed to hereby reduce said disadvantages. This concept is essentially based on the fact that the turbo group is arranged in a lane between the steam generators and a portal crane is mounted on the steam generators in order to facilitate both their assembly as well as the assembly of the turbo group. In addition, the principle of multipurpose use has been realized in such a way that the support frames of the steam generator or the coal bunker are at the same time equipped for receiving secondary installations, and the portal crane is able to serve both steam generator and power generator parts. The steam power plant constructed according to this concept is very compact and is brought together within a tight outline. The main emphasis of this solution is the reduction of construction time and expenditures. The price for the advantages of a small space requirement and multipurpose use of support frames is a vertical arrangement of numerous installation parts. But it is especially this vertical arrangement of numerous installation parts whose assembly is facilitated with the highly positioned portal crane during the construction phase, that excludes a use of the crane for necessary repair and maintenance purposes of the same installation parts in the operation phase. After the construction phase, the crane 's use is essentially limited to the turbo group, since it is unable to access the installation parts of all intermediate planes.

DESCRIPTION OF THE INVENTION

The invention is designed to remedy this problem. Starting with the mentioned state of the art, the invention is based on the objective of creating a steam power plant characterized by very friendly maintenance and repair friendliness. In addition, a steam power plant should be created that achieves substantial standardization and can be built at a variety of possible sites.

The invention therefore is based on a steam power plant comprising essentially a steam generator, a turbo group with condensation steam turbine and generator, a water-cooled condenser, and a bleeder steam-heated pre-heater system and a portal crane and is characterized in that all components of the steam power plant, including the fuel storage site, are located at ground-level and placed in an open air arrangement and the portal crane swings over an area in which the turbo group with the condenser, pre-heater system and associated pumps as well as the transformers are arranged.

If the steam generator, flue gas cleaning system and chimney are located in series within a common flue gas axis, it is useful that the turbo group is located immediately adjacent and parallel to them.

If the fuel storage site is a coal heap, it would be suitable to locate it down-wind—seen in the main wind direction—behind the turbo group and steam generator.

The advantage of all these measures is in particular that the standardization of the installation engineering and of the components reduces the investment costs to a remarkable degree. The outline of the power plant is formed by a clearly defined rectangle. This makes it possible to expand the installation at any time by simply placing such rectangles next to each other. The previously common, very extensive project engineering is no longer required hereby. The power plant blocks that will be located next to each other are identical; only the access roads must be minimally adapted. Another advantage is the consistently realized open air placement. This makes it possible to forego the expensive and time-consuming construction of buildings, such as boiler and machine house. The measure of arranging the turbo group with the condenser, pre-heater system and associated pumps, as well as with at least the own-demand transformers in such a way that a portal crane can swing over them also defines a rectangular cross-section for these components. This makes it possible to arrange the installation parts in the tightest space directly next to each other without negatively affecting operation and maintenance. Maintenance and repair work can be performed with the crane. This arrangement also enables the shortest possible connections between the various installation parts, which again has a positive effect on assembly and maintenance.

The sensible measure of locating the coal heap downwind behind the turbo group and the steam generator in no way has an adverse effect on the requirement of a rectangular cross-section of the installation and can be performed independently from the wind direction. This makes it possible to avoid coal dust emissions in the area of the technical installations and administrative operations. The desired rectangular cross-section in any case can also be realized in relation to the geographical location of the body of water necessary for cooling purposes. The respective situation plan in each case naturally takes into account this water location, whereby the emphasis here is also on the shortest possible connection paths.

A flatbed feeder located at ground level is provided for depositing the unground coal onto the inclined belt to the coal breaker. This means that the large and deep, concrete-lined, subterranean feeder pit that usually was required up to now is no longer necessary, which greatly reduces civil engineering work.

The steam generator is preferably supplied with roughly ground coal from coal silos. It is hereby reasonable that the coal silos associated with the steam generator are connected with the coal breaker located upstream from the steam generator by an at least approximately horizontally extending conveyor device with subsequent vertical conveyor device. The ground-level placement of the horizontally extending conveyor device makes it possible to eliminate complicated steel frames.

The steam turbine has an axial exit so that the steam condenser is located in the axial extension of the steam turbine. This solution, which is advantageous because of the almost ground-level placement of the turbo group, as well as the open air placement, allows unlimited access to the condenser. If condenser pipes must be replaced, this does no longer require removal facade elements from a building, as was the case in the past. In addition, the portal crane swinging over the condenser can be used for such maintenance procedures.

It is advantageous if all pre-heaters are designed for the same pressure on their water side, have essentially the same dimensions, and are located adjacent to the turbo group. This measure guarantees the shortest connections both on the water and steam side and also allows use of the portal crane for maintenance work.

Starting with the recognition that because of lacking advance planning and customization to client specifications the construction time for a power plant is extraordinarily long today, the invention, as characterized in the claims, is based on the task of achieving substantial standardization and creating a power plant that can be built at a variety of possible sites.

BRIEF DESCRIPTION OF DRAWING

The drawing shows an exemplary embodiment of the invention in the form of a single-shaft, axial-flow turbo group with coal as the primary fuel. Only elements essential to understanding the invention are shown. What is not shown of the installation is, for example, the numerous lines between the machines and equipment as well as most of the termination and control fittings, etc. The flow direction of the various working media is shown by the arrows. In the drawing:

FIG. 4 shows the transport path of the coal from the coal heap to the steam generator;

FIG. 6 shows the cooling water removal;

FIG. 7 shows the liquid fuel diagrammatic;

WAY OF EXECUTING THE INVENTION

Figure 1:
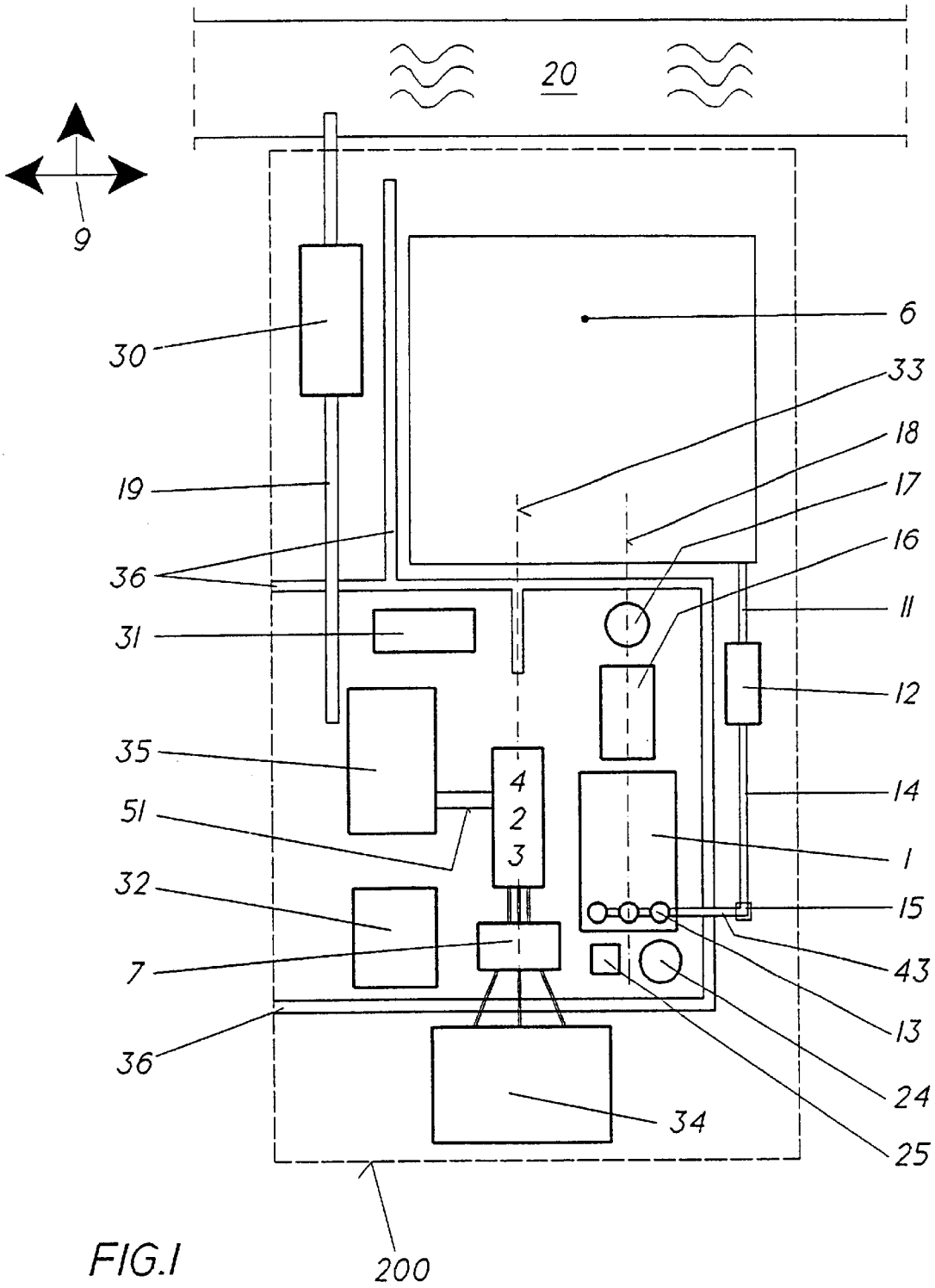
FIG. 1 shows the principle layout of the installation.

According to FIG. 1, an installation module containing all of the power plant components carries the reference number 200. Such a module could comprise, for example, a 150 MW installation and is preferably built in an exclusively industrial zone in order to protect neighbors from emissions, such as dust, noise, and truck traffic. Reference number 6 indicates the fuel storage site. In this case, this is an open coal storage having a rectangular outline. In the shown example, the coal heap is located directly adjacent to a river 20, which means that the coal can be delivered by ship. Naturally, it my also be delivered by train or trucks over access roads 36. If the installation is near a coal mine, transport via conveyor belts would also be possible.

Based on this coal heap 6, the basic orientation of the power plant elements is then determined by the main wind directions 9.

The coal is first piled with a shovel dozer 49—that also can be used for excavation work during the construction phase—from the heap 6 onto a flatbed feeder 10 (FIG. 4). From there, the piled up transported material 41 reaches the inclined belt 11 leading to the coal breaker 20. As already mentioned initially, the feeder 10 eliminates the need for a concrete-lined pit in which the coal is guided via funnels onto a conveyor belt. Since the feeder 10 is located at ground-level on a foundation plate, this new measure, in comparison to the pit solution, also reduces the length of the inclined belt 11 that must convey the material to the inlet of the breaker building 12 which is usually located at a height of about 15 to 20 meters.

From the coal breaker, the transported material is first transported via a horizontal conveyor device 14 and then via a vertical conveyor device 15 to a horizontal conveyor 43 from which it is filled into the coal silos 13. This solution has several advantages over the previously common inclined belt conveyance to the silos. Since the charging system of conventional boiler silos is usually located at a height of 50 meters, an inclined belt conveyance with the usual 14° to 15° incline must be almost 200 meters long. The present new measure makes it possible to reduce this length drastically, so that the coal breaker 20 can be located very close to the boiler. Furthermore, the horizontal conveyor device 14 can be built at ground level on simple concrete ties. Extensive steel constructions, such as in the case of inclined belt conveyance, which also require a high crane capacity during assembly, are no longer necessary. It should be understood that the access to a horizontal conveyor belt extending at ground level is also simplified because of the elimination of operating and walking ways.

This type of construction—first horizontal, then vertical—also allows the principal standardization of the subsequent vertical conveyor device 15. This is an encased bucket conveyor with a simple carrying structure that is also positioned at ground level and is preferably connected with the boiler structure in order to take up horizontal loads. Because of all of this, only the length of the horizontal conveyor device 14 must be adapted to different situations in each case, i.e. the distance between coal heap and boiler.

The steam generator 1 works with atmospheric fluidized bed combustion. Hereby roughly broken coal with a particle size of about 6 mm can be used. The advantage in this is that in addition to the coal breaker 20 no additional coal mill is required. The steam generator is held in a steel frame; an exterior encasing or roof is no longer necessary.

FIG. 1 shows that a tank 24 for liquid fuel is located directly before the steam generator. This liquid fuel is necessary for starting up the steam generator and for the stabilizing fire. The location of this tank has been chosen with respect to short conveyance distances. The tank itself is located in a concrete collecting basin. The pumps 25 for the start-up fuel are located immediately next to the tank 24 on pedestals projecting from the concrete foundation plate. This foundation plate is hereby constructed as a collecting basin for the pump area.

The tank can be filled from the road 36 by tanker trucks. It was found that an advantageous solution is to use the pumps 25 for the start-up fuel both for charging the burners and for filling the tank. FIG. 7 shows how this can be realized. To fill the tank, the pump 25 withdraws fuel from the tanker truck via an appropriately set three-way element 47 and transports it via another appropriately set three-way element 46 through filling line 48 into the container. To start up the steam generator and for the stabilization fire, the pump 25 again transports the fuel from the tank 24 to the burners 45 of the boiler 1 by way of three-way elements 47 and 46 that are again set appropriately.

Since the steam generator 1 functions with atmospheric fluidized bed combustion, no desulfuration of the flue gases is necessary. Accordingly, the boiler is followed immediately by the flue gas cleaning system 16 that consists essentially of an electrostatic separator or a fibrous filter. The cleaned waste gases are released through the chimney 17 into the atmosphere. FIG. 1 shows that the steam generator 1, the flue gas cleaning system 16, and the chimney 17 are located in the longitudinal axis of the boiler in a so-called flue gas axis 18.

The machine axis 33 then extends parallel to this flue gas axis 18. The turbo group 2,3 and the condenser 4, as well as the transformers 7 and preferably the open air switching installation 34 are arranged in this axis. Here the difference to other installations in which the turbo group is usually located at the frontal face of the steam generator 1 can be seen.

Module 200 further shows the road system 36 that permits access to the installation, a workshop 31, and a switching installation system 32, as well as the cooling tower system 35, the added water 19 leading there, and the water reprocessing system 30. To keep the piping short, a placement of the cooling tower system as close as possible to the condenser 4 is desired. An above-ground arrangement has been selected for these pipes so that the construction work for the installation construction is not adversely affected. For the alignment of the cooling cells with each other, both the function of the predominant wind direction as well as the distance to the turbine and boiler was considered; the objective hereby is not to adversely affect the ventilation of the cooling towers.

The added water is removed without the previously common, extensive intake mechanisms. FIG. 6 shows that the added water is transported in the simplest manner via a dirty water pump 22. In the present example, this pump is located in a concrete pipe 21 that can be submerged in the body of water 20. The concrete pipe preferably consists of individual, stacked concrete rings, of which at least one is provided with inlet openings 44. The pipe 21 and pump 22 stand on a thin concrete plate placed into the river bottom. The water removal unit can be accessed via a walkway 37. The water pipes 19 extend near the bottom and are supported on ties 38.

As much as possible, mechanical and electrical accessories are prefabricated and pre-assembled and are transported to the installation in transport containers. For assembly, the containers are placed by a crane on simple concrete ties. This reduces both the customization engineering and the assembly time. The same applies to the entire lubrication and control oil system, including oil tank and pumps, that can be delivered pre-assembled and are placed immediately next to the turbo group into a concrete collecting basin.

Figure 2:
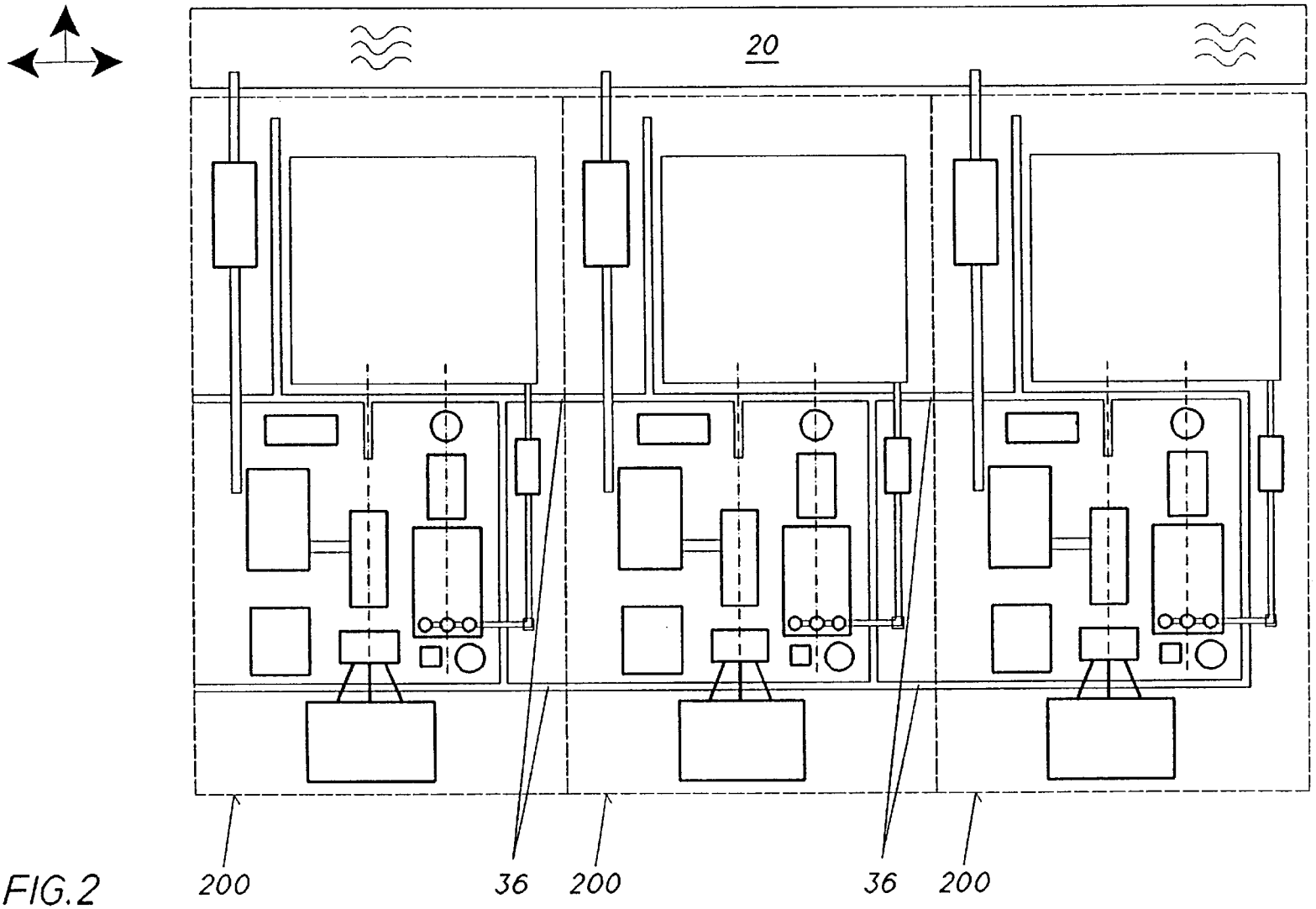
FIG. 2 shows a multi-installation.

For the same wind direction and same river course as in FIG. 1, FIG. 2 shows an arrangement of three modules 200. The only difference to the installation according to FIG. 1 is the continuous roads 36. This shows that an installation can be expanded at any time without adversely affecting the operation of the already existing modules. If it is even known before a power plant installation is built, that it will eventually consist of several modules, naturally a common coal heap and common cooling water removal will be considered.

Figure 3:
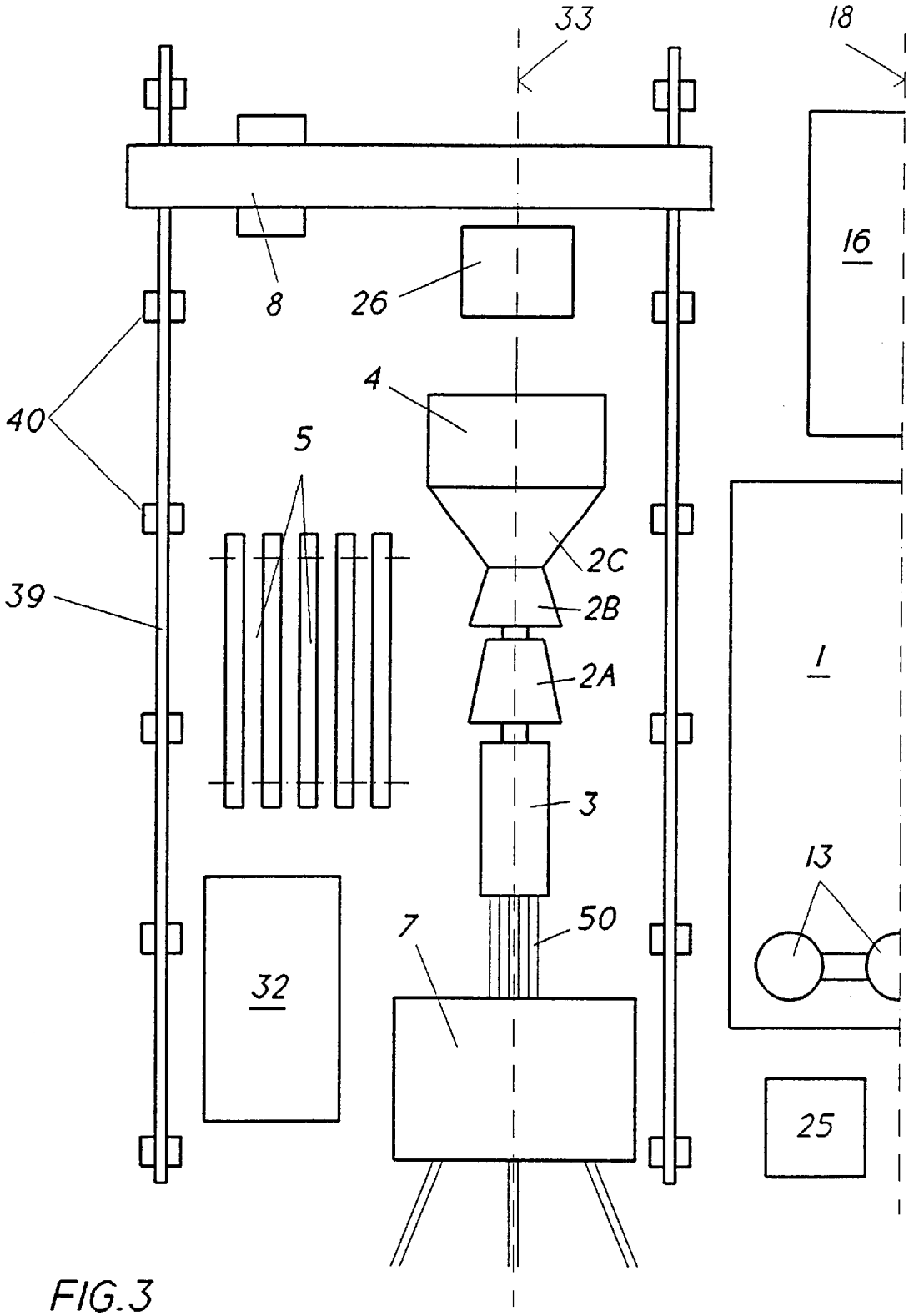
FIG. 3 shows a top view of the turbo group and adjacent area.

FIG. 3 shows those elements over which the portal crane 8 swings according to the present invention. At the right edge of the illustration, the flue gas axis 18 with the elements pumps 25 for start-up fuel, coal silos 13, steam generator 1, and flue gas cleaning system 16 are shown. The fact that the installation does not need any buildings and the arrangement of the pre-heaters on the side facing away from the boiler—described below—now makes it possible that the actual turbine 2 can be located directly adjacent to the boiler 1, thus enabling extraordinarily short connecting lines not shown in this figure. This particularly holds true for the fresh steam line.

The crane tracks 39 of the portal crane 8 are supported on both sides on concrete columns 40, so that the passage of steam lines, water lines, and cable channels is not hindered. Their length is such that they include the own-demand transformer 7 and the feed pump block 26, both of which are arranged in the machine axis 33. The crane width has been selected so that the crane (8) is also able to serve the pre-heater system 5 and the switching system building 32, both of which are constructed in container construction. This shows that this crane (8) is also required for the initial construction of the installation, so that no mobile lifting systems are necessary. Accordingly, the loading capacity of the crane is designed for the heaviest turbine parts that must be moved during assembly. This does not apply to the generator 3 that is preferably brought into its operation position via skid rails.

The advantage of the ground-level placement of all mentioned elements and their operation via portal crane cannot be underestimated. Especially in those market segments that permit an open air arrangement of the installation, among others for climatic reasons, often mobile cranes with an adequate design and loading capacity are not available. This is especially true if the completed installation deviates from the plan, in which case this must be immediately remedied.

Where the actual machine is concerned, in this case comprising a steam turbine with a high-pressure part 2A, an intermediate pressure part 2B, and a low pressure part 2C, as well as a generator 3, the term "ground level" must be qualified. In fact, this is an almost ground-level placement, whereby it should be understood that it is not a construction in which the machine is placed onto a foundation table that itself is supported by steel or concrete columns. This almost ground-level placement of the machine is made possible because the waste steam of the low-pressure turbine 2C is axially oriented, and the condenser neck of the condenser 4 that is located on the same level is connected via flange with the waste steam. As a result of this construction, the machine axis 33 is only 5.5 meters above the ground, eliminating the need for the usual operating platform around the machine and any intermediate floors. Platforms with corresponding staircases are only provided at places where an access for operating personnel and maintenance purposes is absolutely necessary.

The turbo group 2, 3 with condenser 4 is supported by a simple, monolithic concrete foundation plate, whereby column plates projecting from the foundation support the bearings and cases. The above mentioned required platforms are located at a height of about 4.5 m above the ground. The oil lines are placed on them.

Because of the open air arrangement, the turbine cases are equipped with weather-resistant covers with correspondingly designed ventilation openings. These covers are also supported on the mentioned platforms.

All turbine housings are provided with a horizontal separation level, and at least all steam bleeder lines (110 in FIG. 5) are arranged on the respectively lower housing half. This means that these lines need not be removed when the top housing halves are covered as required during maintenance work on the blades or rotor. The low placement of the lines above the ground that results from this also has the advantage that the supports for the pipes can be constructed simply and can be simply installed even during the initial assembly. Access during any necessary welding work, tests, and insulations is also simplified. The close-to-the-ground placement of the bleeder steam lines now suggests that the feed water pre-heaters 5 are arranged accordingly. They are located immediately adjacent to the turbine. In the example of a 150 MW installation, the pre-heater installation consists of five devices located next to each other. It should be understood that they could be partially located on top of each other—without deviating from the underlying concept of ground-level placement—for example 3 pre-heaters on the ground, and 2 pre-heaters above them. The decisive factor here is that they can be operated from the portal crane 8. The selected arrangement next to the turbine 2 results in short bleeder steam lines. The fact that they are not located on the boiler side but on the opposite side has the advantage that the bleeder steam lines and the steam lines leading to the steam generator are separated from each other. The close-to-the-ground placement of the pre-heaters also allows simple supports in the form of concrete pedestals that also carry the feed water lines and bleeder steam lines.

All pre-heaters 5 essentially have the same dimensions and are designed on the water side for the same pressure. This already indicates that the water-steam cycle is designed so that it does not need a feed water tank/degasser. This usually large and heavy device is usually arranged at a height of about 15 meters and requires the corresponding expensive supports. By eliminating this tank and the corresponding line placement, a significant reduction in investments costs and assembly time can be realized.

The water-steam cycle is shown in a simplified manner in the heat diagrammatic in FIG. 5 and shall be briefly described below. The feed water enters the economizer 101 of the steam generator 1 at the usual conditions (170 bar, about 250° C.) and from there reaches the steam collecting drum 103. In the natural cycle, the water is passed through the evaporator 102 and then, as saturated steam, back into the drum. In the multi-part superheater 104 (not shown), it is heated to its final temperature of 540° C. and conducted via the fresh steam line 105 into the high pressure part 2A of the steam turbine. There, the steam is expanded to a pressure of about 40 bar while releasing power in the process. The steam is returned via the cold intermediate superheater line 106 into the boiler, is reheated in the intermediate superheater there again to 540° C., and is conducted via the hot intermediate superheater line 108 into the intermediate pressure part 2B of the steam turbine. After repeated partial expansion, the steam passes from the intermediate pressure part into the low pressure part 2C, in which it is expanded to condenser pressure. In the water-cooled condenser 4, the steam is condensed, the condensate collects in the hot well (not shown), from where it is transported by the condensate pump 111 into the pre-heater system. To this extent, such installations are known.

To simplify the pre-heater system, the following concept has now been chosen. The feed pump 26 is constructed in two stages. On the water side, a primer pump 27 is arranged upstream from the pre-heaters 5, and a main pump 28 is arranged downstream from the pre-heaters. The two-stage feed pump is provided with a common drive 29. In the pre-heaters, the feed water is heated to the boiler inlet temperature with bleeder steam removed via the stages of turbines 2A–2C that correspond to bleeder lines 110. The two-stage execution of the feed pump has the advantage that all pre-heaters can be designed on their water-side for the same low pressure and therefore can be manufactured in a cost-efficient manner. The final pressure of the primer pump 27 is selected as a function of the pressure loss within the pre-heater train and the permissible inlet pressure of the main pump 29.

As a special feature, a compensation tank 23 for cold condensate is provided in the pre-heater train between the condensate pump 111 and feed pump 27. This tank can function with a steam or inert gas pressure cushion and is used to supply the feed pump 27. This tank is used especially in non-stationary operating conditions.

Figure 5:
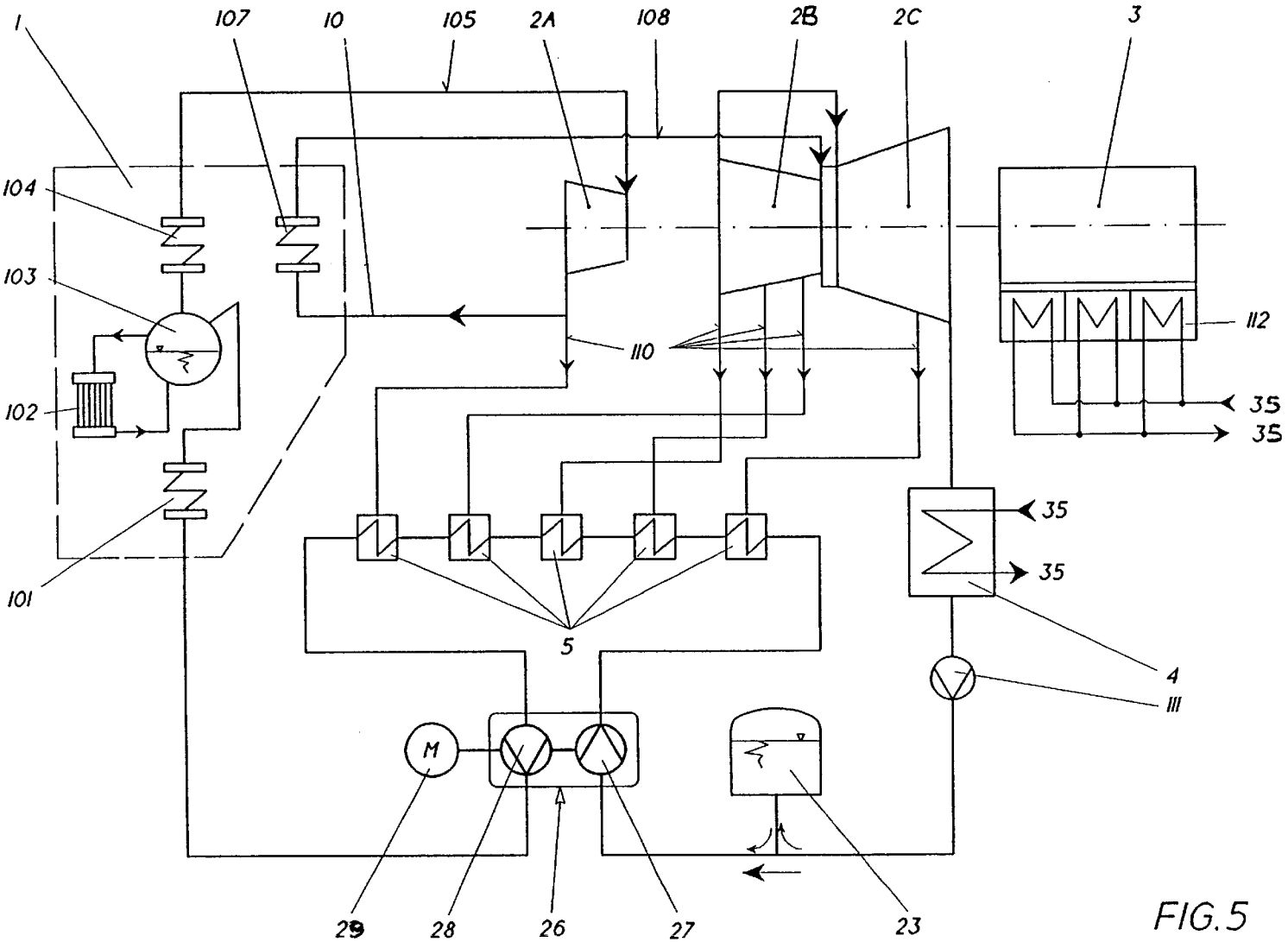
FIG. 5 shows the heat diagrammatic of the installation.

The heat diagrammatic of FIG. 5 also shows the generator 3. This generator 3 is air-cooled, whereby the cooler box 112 is connected with a flange directly to the generator. A special feature here is that for the recooling of the cooling air circulating in the closed circuit non-desalinated cooling water is removed from the main cooling circuit 51. In contrast to previous air/water coolers whose cooling elements were in most cases constructed of copper or nickel, stainless steel is used for this purpose. Nevertheless, the cooling water system is still more cost-efficient, since the use of main cooling water for cooling the generator makes it possible to construct the intermediate cooling system needed for other purposes, which works with reprocessed water, smaller and therefore cheaper.

The fact that the generator axis also is located at a height of about 5.5 meters above ground makes it possible to arrange the generator switches and exciter equipment (not shown) below the generator. They may be located on a simple concrete plate. The generator output lines are therefore located at the underside of the generator and extend serially, therefore resulting in the shortest possible line lengths. This solution prevents complicated support constructions, such as are known from the lateral exit of the output lines above the generator.

FIGS. 1 and 3 show the placement of the transformers 7 immediately near the generator 4, which results in short bus bars 50. The own-demand transformer and block transformers are separated from each other by a fire protection wall. The installations has been designed so that at least the own-demand transformer can be operated from the portal crane.

The switching system 34 can be designed as a gas-insulated high voltage module, which in the one hand significantly reduces the amount of space required, and on the other hand makes it possible that the switching system can be constructed very closely to the transformer system. The switching systems and attendance room are also constructed as containers. The modules are placed as prefabricated units with the portal crane onto a ground-level foundation plate with a surrounding pedestal. The space created in this way is used as a cable cellar.

Figure 8:
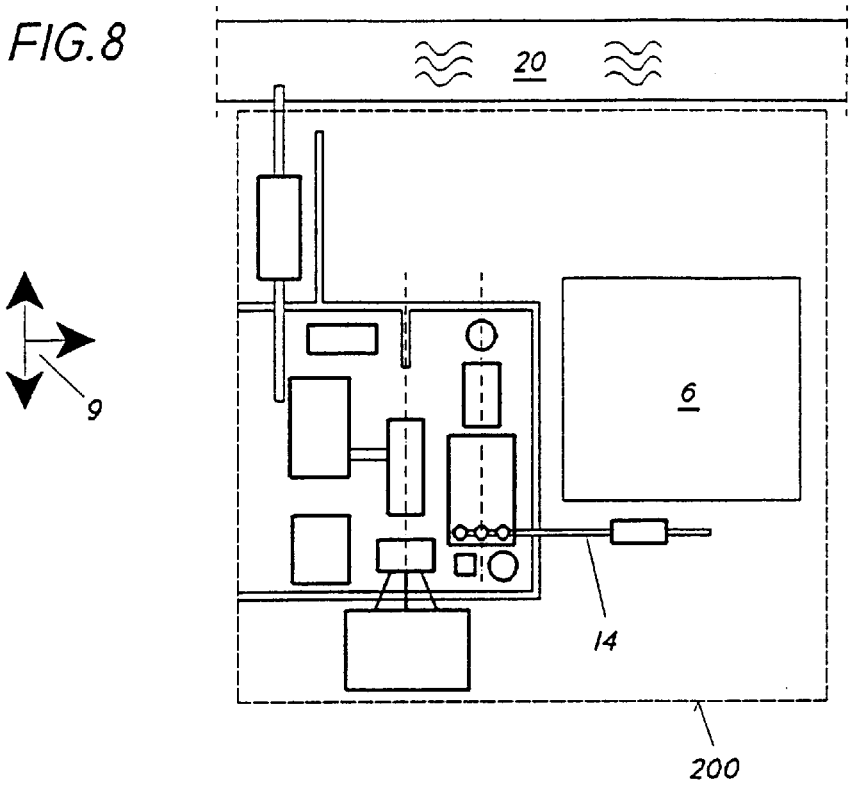
FIG. 8 shows the principle layout of the installation for a different wind direction.
Figure 9:
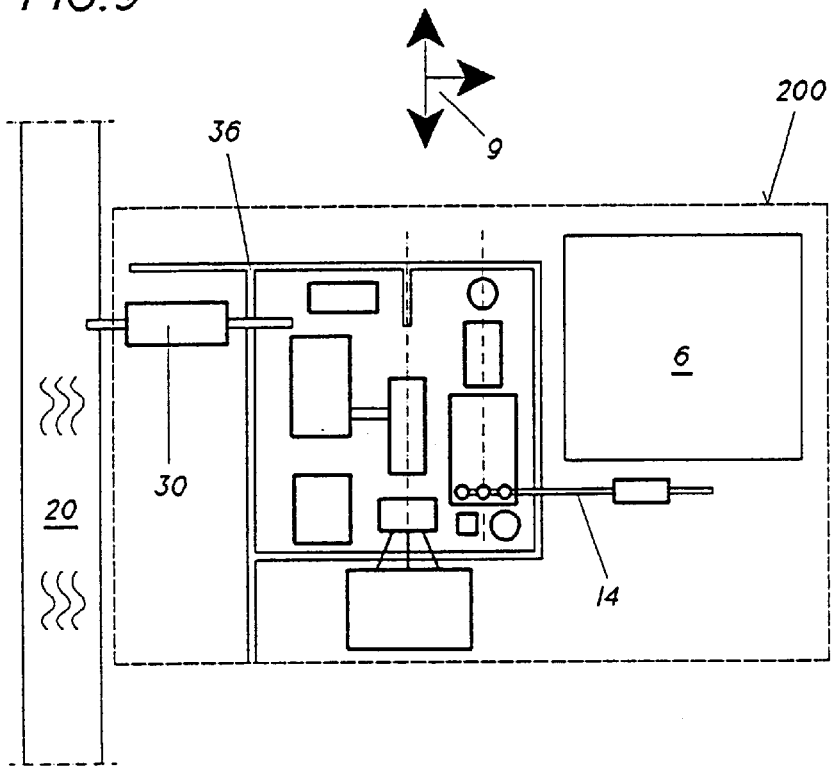
FIG. 9 shows the principle layout of the installation with a different location of the body of water.

FIGS. 8 and 9 show the selected principal layout for another wind direction and, respectively, for another course of the body of water. According to specification, the coal heap 6 in both arrangements is located down-wind. The figures show the great advantage of the coal transport concept. Only the length and course of the horizontal conveyor 14 must be adapted to the new situation. The installation in FIG. 9 differs from that in FIG. 8 by the different course of the river 20. Because of a differently designed water removal, this only results in a different geometry of the module 200.

List of Reference Numbers

1 steam generator
2 condensation steam turbine
2A high pressure part
2B intermediate pressure part
2C low pressure part
3 generator
4 condenser
5 pre-heater system
6 fuel storage site
7 transformers
8 portal crane
9 main wind direction
10 flatbed feeder
11 inclined belt
12 coal breaker
13 coal silo
14 horizontal conveyor device
15 vertical conveyor device
16 flue gas cleaning system
17 chimney
18 flue gas axis
19 added water
20 body of water
21 concrete pipes
22 dirty water pump
23 cold condensate compensation pump
24 liquid fuel tank
25 pump for start-up fuel
26 feed pump
27 primer pump
28 main pump
29 feed pump drive
30 water reprocessing system
31 workshop
32 switching system building
33 machine axis
34 switching system
35 cooling tower
36 access road
37 walkway
38 tie
39 crane track
40 concrete columns
41 transported material
43 horizontal conveyor
44 inlet openings in 21
45 burner in 1
46 three-way element
47 three-way element
48 filling line
49 bucket loader
50 bus bar
51 main cooling water
101 economizer
102 evaporator
103 steam collecting drum
104 superheater
105 fresh steam line
106 cold intermediate superheater line
107 intermediate superheater
108 hot intermediate superheater line
110 bleeder line
111 condensate pump
112 generator cooling module
200 module

What is claimed is:

1. A steam power plant with close-to-the-ground placement, comprising essentially a steam generator, a turbo group with condensation steam turbine and generator, a water-cooled condenser, and a bleeder steam-heated pre-heater system and a portal crane swinging at least over the turbo group wherein all components of the steam power plant, including a fuel storage site, are located at ground-level and placed in an open air arrangement, and the portal crane swings over an area in which the turbo group with the condenser, pre-heater system and associated pumps as well as the transformers are arranged.

2. A steam power plant as claimed in claim 1, wherein said all components of the steam power plant, including the fuel storage site, form a module with a rectangular outline.

3. A steam power plant as claimed in claim 2, wherein a plurality of said modules are located next to each other.

4. A steam power plant as claimed in claim 1, wherein the steam generator is supplied from at least one coal silo with coal, whereby the at least one coal silo is connected with the fuel storage site via a ground-level feeder, an inclined belt, a coal breaker, and an at least approximately horizontally extending conveyor device with adjoining vertical conveyor device.

5. A steam power plant as claimed in claim 1, wherein the steam generator, a flue gas cleaning system and a chimney are arranged serially in a common flue gas axis, and that the turbo group is hereby arranged immediately near them and parallel to them.

6. A steam power plant as claimed in claim 1, wherein a low pressure steam turbine of the turbo group has an axial exit, and the steam condenser is located in axial extension of the steam turbine, whereby bearings and housing are supported directly on concrete pedestals located on a ground-level foundation.

7. A steam power plant as claimed in claim 1, wherein all pre-heaters are designed on the water side for the same pressure, have essentially the same dimensions, and are arranged so as to adjoin the turbo group.

8. A steam power plant as claimed in claim 7, wherein upstream from the pre-heater system a compensation tank loaded with cold condensate is provided.

9. A steam power plant as claimed in claim 7, wherein a feed pump is constructed in two stages, whereby on the water side a primer pump is arranged upstream from the pre-heaters, and a main pump is arranged downstream from the pre-heaters.

10. A steam power plant as claimed in claim 9, wherein the two-stage feed pump has a common drive.

11. A steam power plant as claimed in claim 1, wherein the generator is air-cooled, and that for the recooling of the cooling air circulating in the closed circuit non-desalinated main cooling water is removed from the condenser cooling cycle.

12. A steam power plant as claimed in claim 1, wherein the added water is transported by a dirty-water pump provided with inlet openings and located in a concrete pipe submerged in a body of water.

13. A steam power plant as claimed in claim 1, wherein liquid fuel that is stored in a tank located immediately adjacent to the steam generator is used for starting up the steam generator and for the stabilizing fire, whereby pumps for the start-up fuel are used both for feeding burners as well as for filling the tank.

* * * * *